US008734198B1

(12) United States Patent
Seldin

(10) Patent No.: US 8,734,198 B1
(45) Date of Patent: May 27, 2014

(54) EDUCATIONAL TOY, GEOMETRIC PUZZLE CONSTRUCTION SYSTEM

(71) Applicant: Edward B. Seldin, Cambridge, MA (US)

(72) Inventor: Edward B. Seldin, Cambridge, MA (US)

( * ) Notice: Subject to any disclaimer, the term of this patent is extended or adjusted under 35 U.S.C. 154(b) by 0 days.

(21) Appl. No.: 13/840,706

(22) Filed: Mar. 15, 2013

(51) Int. Cl.
*A63H 33/04* (2006.01)
*A63H 33/00* (2006.01)

(52) U.S. Cl.
USPC ..... 446/125; 273/158

(58) Field of Classification Search
USPC ..... 446/486, 487, 489, 124, 125; 273/156, 273/158, 159; D21/105, 106, 107
See application file for complete search history.

(56) References Cited

U.S. PATENT DOCUMENTS

| | | | | | |
|---|---|---|---|---|---|
| 479,145 | A * | 7/1892 | Whitworth | 273/158 |
| 646,403 | A * | 3/1900 | Klipfel | 273/158 |
| 788,048 | A * | 4/1905 | Jensen | 273/158 |
| 1,168,987 | A * | 1/1916 | Wixom | 273/158 |
| 1,850,859 | A | 3/1932 | Woodman | |
| 3,778,994 | A | 12/1973 | Humphries | 57/149 |
| 4,575,472 | A | 3/1986 | Lefferts | 428/222 |
| 4,685,681 | A | 8/1987 | Rubik et al. | 273/155 |
| 5,524,396 | A * | 6/1996 | Lalvani | 52/81.1 |
| 5,906,639 | A | 5/1999 | Rudnick et al. | 623/1.15 |
| 5,913,896 | A | 6/1999 | Boyle et al. | 623/1.15 |
| 5,972,463 | A | 10/1999 | Martin et al. | 428/95 |
| 6,080,482 | A | 6/2000 | Martin et al. | 428/373 |
| 6,319,277 | B1 | 11/2001 | Rudnick et al. | 623/1.13 |
| 6,322,576 | B1 | 11/2001 | Wallace et al. | 606/191 |
| 6,342,068 | B1 | 1/2002 | Thompson | 623/1.53 |
| 6,638,291 | B1 | 10/2003 | Ferrera et al. | 606/191 |
| 7,694,463 | B2 * | 4/2010 | Lanahan | 52/81.1 |

* cited by examiner

*Primary Examiner* — Kien Nguyen
(74) *Attorney, Agent, or Firm* — Hayes Soloway P.C.

(57) ABSTRACT

A three dimensional construction element is provided having a plurality of strands of constant cross-sectional shape and constant cross-sectional diameter, each of said strands being a rigid, non-collapsible helix having at least two and one-half turns. The strands of the plurality of strands are interlocked so as to form a rigid, non collapsible, dimensionally and geometrically stable rosette in which the helix has a constant cross-sectioned diameter.

14 Claims, 18 Drawing Sheets

EDUCATIONAL TOY, GEOMETRIC PUZZLE CONSTRUCTION SYSTEM

FIELD OF INVENTION

The present invention relates to an educational toy three dimensional geometric puzzle and construction system having interlocking components.

SUMMARY

The invention herein embodies an educational toy, three dimensional, geometric puzzle and construction system comprising helical construction units that may be intertwined to form three dimensional structures. According to the present invention, the construction units may be assembled into structures including rigid icosahedral complexes configured in branched, ring, and dodecahedral arrays.

The objects and systems herein disclosed fall into the realm of puzzles and educational toys and consists of a minimum inventory-maximum diversity construction system utilizing helices with unique dimensioning conferring upon them architectonic properties that allow them to be conjoined into objects that shed an educational light upon the so-called Platonic Solids, crystalline lattices and certain rules of geometry and that may have other utility as well.

The central feature of the invention/disclosure is the discovery that, by selecting specific dimensional properties, 3-4-5 or more helices can be conjoined in a ring structure in a manner that further allows the assembly of structures with a geometric regularity dictated by mathematical principles.

Although other construction systems are known that allow the building objects exhibiting geometrical regularity, the system disclosed here is unique in that a single helical construction element supplies both the property of linear extension and also that of connection/fixation. Furthermore, the properties designed into specific helices determine the number and angulation of subunits that can be conjoined in a junctional ring.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION OF THE INVENTION

The defining characteristics of a basic construction helix (apart from its material properties) in accordance with the present invention are:

1. Round cross-sectional diameter;
2. Diameter of the core (or mandrel) around which the helix is formed in its manufacture;
3. Spacing between consecutive turns of the helix, measured at the center of cross-sections, 360 degrees apart;
4. Gap between the helical turns, measured in one of two ways, from the leading height of contour of one to the trailing height of contour of the next: (a) measured on a line parallel to the axis of the core; and (b) measured as the shortest distance between adjacent turns.
5. A minimum of 2.5 turns in extension;
6. Pitch Angle of the helix; and
7. Handedness. Helices are either left or right handed.

The basic construction helix preferably is formed of metal, although other rigid and dimensionally stable materials such as plastic or glass may be used as will become clear from the discussion below.

By appropriate dimensional adjustment of parameters, the junctional ring formed by conjoined helices may unite 3, 4 or 5 helices, the planes within which each of the conjoined helices lie are tangent to and evenly spaced around the junctional ring. The angle between helices and the place of the junctional ring is also determined by the characteristics built into the participating helical sub-units.

By appropriate selection of helical parameters, and with adjustments as may be necessitated by the material properties of the substance used to make the helices (stiffness, elastic modulus, etc.) the angles at which helices project from a junctional ring can be conducive to the formation of higher order structures such as the five platonic solids (tetrahedron, octahedron, dodecahedron and icosahedron) and a series of more complex regular polytopes such as the rhombic triacontahedron or the classic "soccer ball" with a surface of alternating hexagons and pentagons.

In addition to junctional rings conjoining 3, 4 or 5 helices, appropriate adjustments of the helical parameters permit or lead to construction of large ring structures or to second-order helices which open a doorway to the construction of an unlimited array of more complex forms of mathematical and aesthetic interest.

A particular set of helical parameters plays a deterministic role in dictating the higher order structures that can be constructed with multiples of the helical subunits, so defined.

Plato, himself, for whom the 5 regular polytopes are named (the only regular three-dimensional solid forms that can be formed using equilateral triangles, squares or pentagons) viewed these shapes as the inevitable consequence of immutable, eternal laws governing the structure of the universe. Unique to this system of construction, in contradistinction to the prior art, is the use of helices to provide, inseparably, in a single construction sub-unit, the properties of extension and connectivity.

Figure 1:
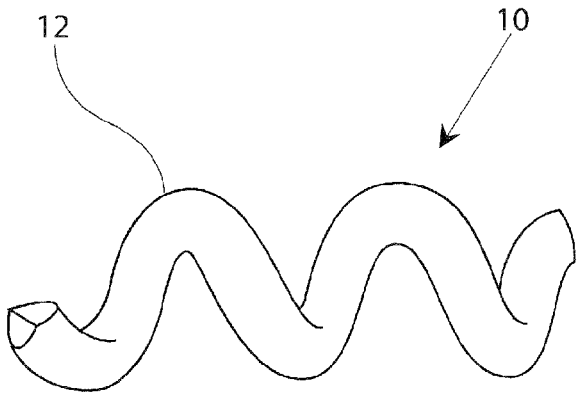
FIG. 1 illustrates a basic exemplary construction helix component consistent with the present invention.

Referring now to FIG. 1, the basic construction unit 10 is illustrated. The construction unit 10 comprises a strand 12 formed as a helix having at least two and one-half turns, wherein the strand 12 may comprise metal, plastic, glass, etc. Furthermore, the strand 12 preferably comprises a round cross-section, although alternate cross-sectional geometries are contemplated herein, for example a square, hexagonal, octagonal, as well as other polygonal or arcuate cross-sections. The pitch of the helix is configured such that three construction units 10 may be coaxially intertwined as a close-fitting triple helix having little, or no, play between the individual construction units 10.

Figure 2:
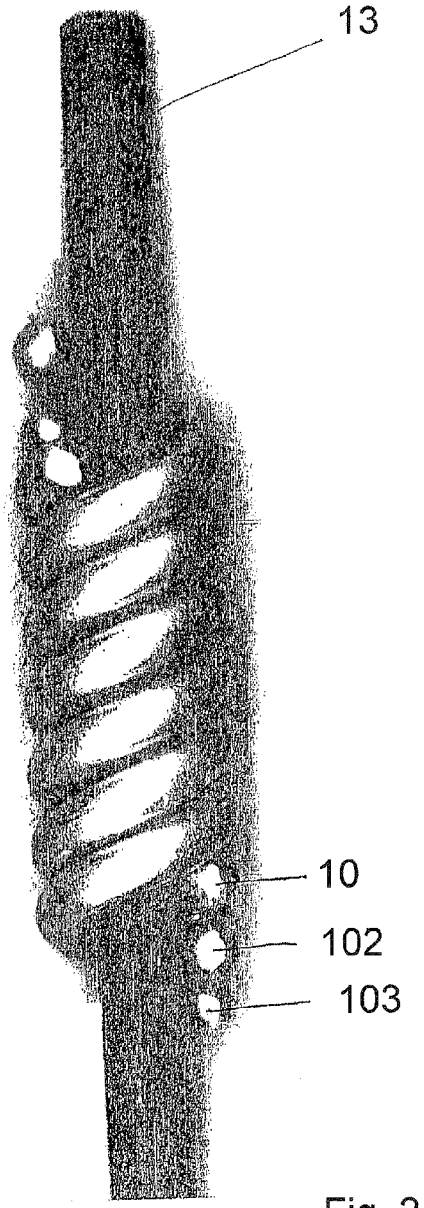
FIG. 2 illustrates three exemplary 2.5 turn exemplary construction components and an exemplary mandrel consistent with the present invention.

The basic helical construction units 10, as shown in FIG. 2, are formed by winding a strand of stock wire 12 with a particular cross-sectional diameter tightly around a cylindrical core, or mandrel 13, to form a double, triple or higher order helix. FIG. 2 shows three 2.5 turn basic helical construction units 10, 102, 103 used to assemble an icosahedron. The mandrel 13 is 1.5 times the diameter of the stock wire 12. For the helices, the most important dimensions are: the diameter of the mandrel 13; the diameter of the strand of stock wire 12 used to form the helices; and the number and diameters of spacing wires used to determine the pitch of the helical construction unit 10. The pitch of the helix is configured such that three helical construction units 10 may be coaxially intertwined as a close-fitting triple helix having little or no play between the individual helical construction units 10.

The strand of stock wire 12 preferably comprises a round cross-section, although alternate cross-sectional geometries are contemplated herein, for example a square, hexagonal, octagonal, as well as other polygonal or arcuate cross-sections. The stock from which the strands 12 are made can, in principle, be of any cross-sectional diameter. The critical factor is the ratio between the diameter of the stock used in the helices and the diameter of the mandrel about which the helices are formed. In practice, the ratio that governs proper assembly of the helical construction units 10 is also influenced by the material properties of the stock wire employed and the method by which the helices are formed around the mandrel.

Figure 3:
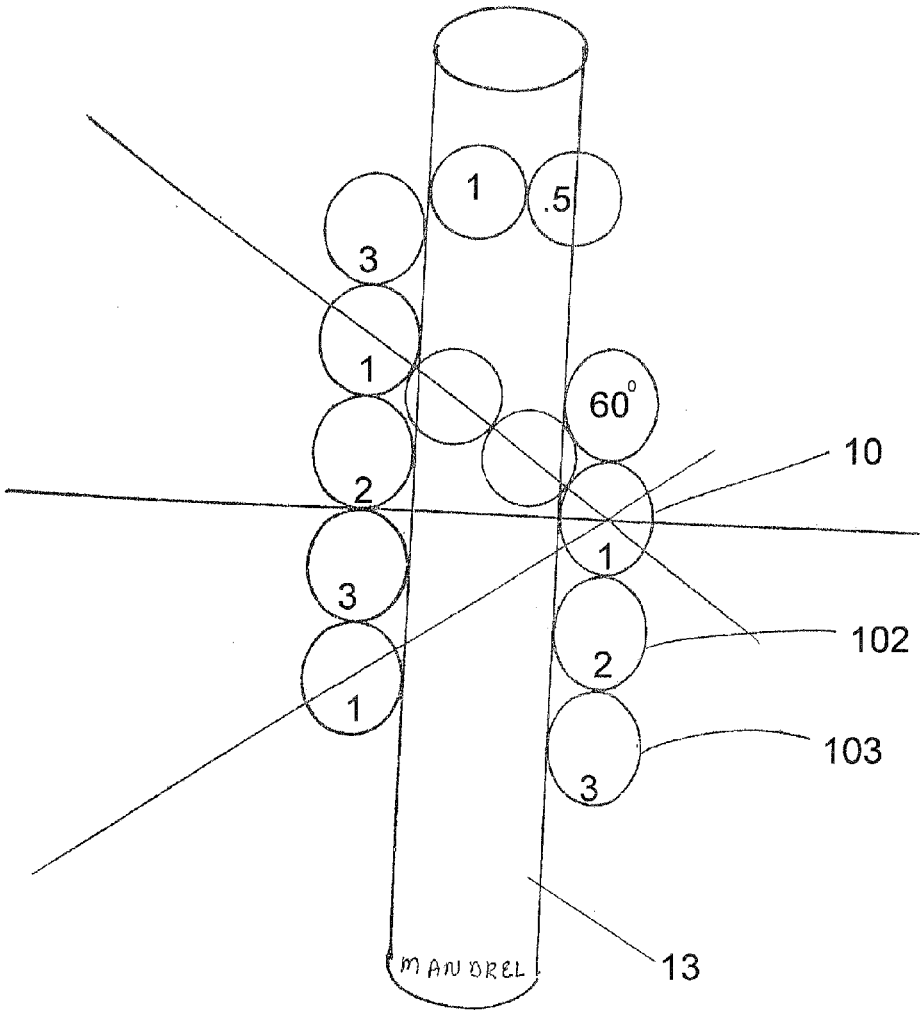
FIG. 3 illustrates a schematic longitudinal section of an exemplary mandrel and three exemplary basic helical construction units consistent with the present invention.
Figure 4:
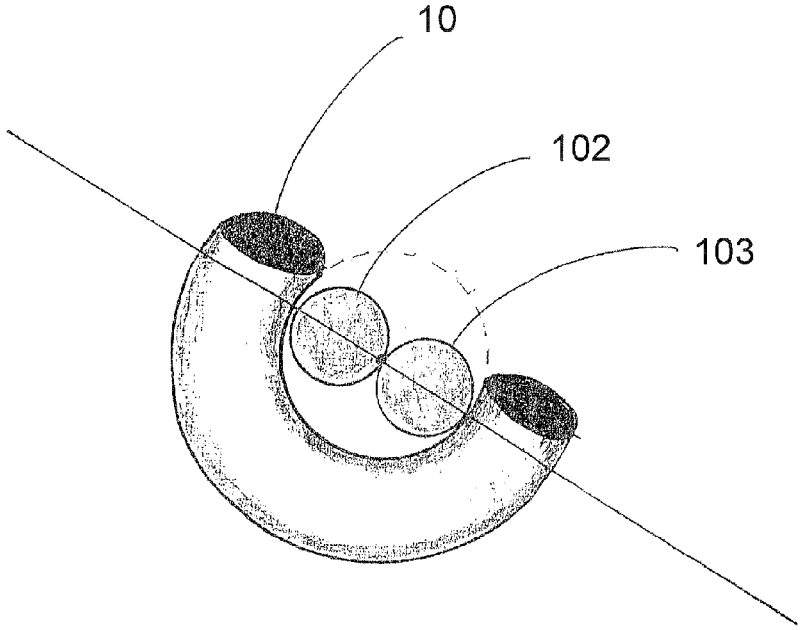
FIG. 4 illustrates a schematic cross-sectional plan of three exemplary construction components consistent with the present invention.

The basic system of construction for the icosahedron will now be described, with the construction of the helical subunits illustrated first:

To form the exemplary helical construction unit 10 for an icosahedron, a triple helix of stock wire plus two spacing wires of identical diameter to the stock wire are tightly wound around the mandrel 13. FIG. 3 illustrates a schematic longitudinal section of a mandrel 13 and three basic helical construction units 10, 102, 103. For icosahedron construction, the mandrel 13, as shown in FIG. 3, is 1.5 times the diameter of the stock wire. With this ratio, two basic helical construction units 102, 103 just fit between diametrically opposed points inside one turn of the basic helical construction units 10. The pitch angle is slightly less than 60 degrees owing to the obliquity of the cross-section of the stock wire. FIG. 4 is a schematic cross-section planar projection of a basic helical construction unit 10 showing two basic helical construction units 102, 103 just fitting between diametrically opposed points inside one turn of the basic helical construction units 10. In practice, the two spacing wires can be left on the mandrel for the formation of additional helices, which are replicated by winding stock wire in the space left when a helix is unwound from the triplet. It is also possible to make a hand-operated or motor-driven machine that will form continuous lengths of helix, with a fixed mandrel and a double helical spacer that is free to rotate as well as translate on the mandrel.

One critical dimension of the construction unit 10 is the ratio between the diameter of the strand and the diameter of the mandrel about which the helix may be formed, i.e., the inside diameter of the helix. The ratio is such that two diameters of strand 12 may fit, preferably with a minimal of clearance, between two diametrically opposed points within the helix in such a manner that a line connecting the centers of said two diameters of strand 12 intersects the centerline of the helix, as will become apparent from the discussion below.

If the cross-sectional diameter of the stock wire from which this helix is formed is set at unity (1), then the diameter of the cylinder (mandrel) about which the helix is formed is approximately 1.5, the precise dimension being a function of the material properties of the stock wire such as but not limited to modulus of elasticity.

The pitch of the helix (or separation between turns is determined by the number of spacing helices separate the turns. In this instance, the spacing is equal to two helices of the same stock wire, tightly wound around a mandrel or otherwise appropriately programmed into suitable wire bending machinery.

The helical sub-unit, so described is one that the inventor has discovered to exhibit the property of being able to be conjoined with like helices in a junctional complex, junctional ring or rosette of precisely 5 such sub-units. (See FIG. 5).

For descriptive purposes, if a helical subunit is referred to as a "second order structure", a straight piece of stock wire is the first order structure.

It will be appreciated that the greater the clearance with which the two diameters of strand 12 fit between the two diametrically opposed points on a helix the less rigid and less stable will be any resultant structure. Furthermore, it should be appreciated that as long as the ratio between the strand diameter and the mandrel diameter is maintained, the strand diameter and mandrel diameter may be varied according to the desired size of the construction units 10 and ultimate structure.

Each construction unit 10 is formed in substantially rigid, dimensionally stable, non-collapsible helix shape. By substantially rigid, it is meant that the individual construction unit is geometrically stable. Thus, when the construction units are assembled together, as will be discussed below, they will form an essentially rigid, non-collapsible rosette in which the individual construction units have essentially the same cross-sectional diameter.

Preferably, but not necessarily, the construction units 10 are formed of metal wire.

Figure 5:
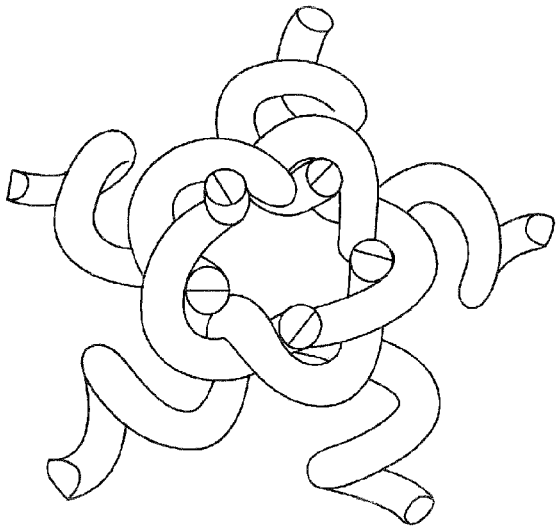
FIGS. 5-18 show various constructions made possible according to the present invention.

As illustrated in FIG. 5, a basic structure may be assembled from five construction units 10, wherein the structure is an interlocking rosette possessing penta-radial planar symmetry. As discussed above, the rigidity of the rosette is dependent upon the material properties, e.g. modulus of elasticity, and the tolerance of the construction units 10, including the pitch and the strand diameter to mandrel diameter ratio.

FIG. 5 demonstrates a junctional ring with penta-radial symmetry, the characteristics of which are wholly determined by the dimensionality of the constituent helical sub-units. It will be noted that each helix in the ring is intertwined with two adjacent helices in such a way that radial symmetry of the junctional ring is established and maintained. The degree of rigidity on the junctional complex depends on the material properties of the stock wire and the dimensioning of the subunits—adjusted so as to secure a sufficiently tight fit of helices and thereby maintain the structural integrity of the constructed object, as a whole. In addition, the properties designed into the helical sub-unit determine the out-of-plane axial inclination of subunits with respect to the plane of the juctional complex.

Figure 6:
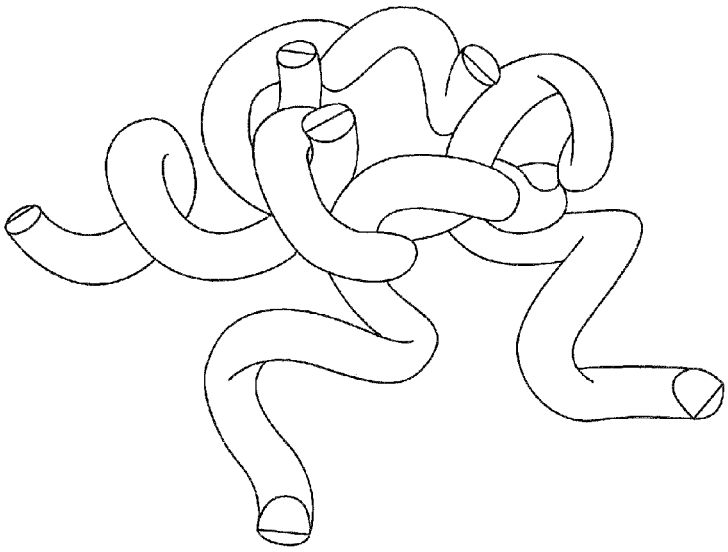

FIG. 6 is an oblique view of the FIG. 5 construction to better demonstrate the out-of-plane orientation of helical subunits participating in the complex.

It will be noted that the central axis of each helix is obliquely tangent to an imaginary circle concentric with the junctional ring. The central axis of each helical sub-unit therefore has a skewed orientation relative to the "imaginary lines" formally representing the apex of the related figure; in this instance, an icosahedron (See figures to follow).

Figure 7:
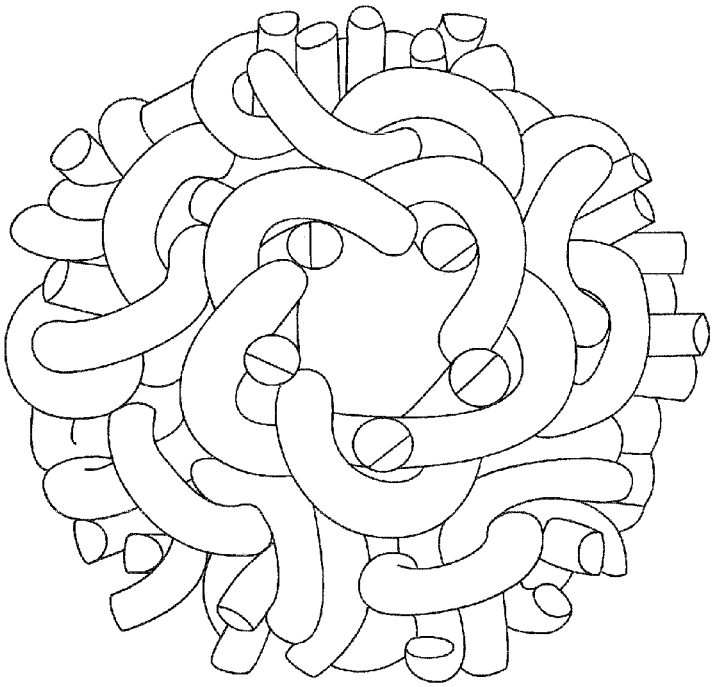

Further, consistent with the above described assembly of the rosettes, the construction units 10 may be assembled into larger and more complex structures. FIG. 7 shows an icosahedral structure (20 faces, 12 apices and 30 edges, in accordance with Euler's formula). In this example, the skewed structure departs in a totally regular way from the ideal linear representation of an icosahedron. In this embodiment, the "faces" are not obvious but consist of the small triadic symmetrical spaces, each, between three helices.

In this embodiment, an "Apex" is represented by the junctional rosette, the actual center of which is an imaginary point. Also in this embodiment, an edge is represented by the imaginary central axis of a helical subunit. Each of these central axes intersect an imaginary edge on an inscribed imaginary icosahedron.

Figure 8:
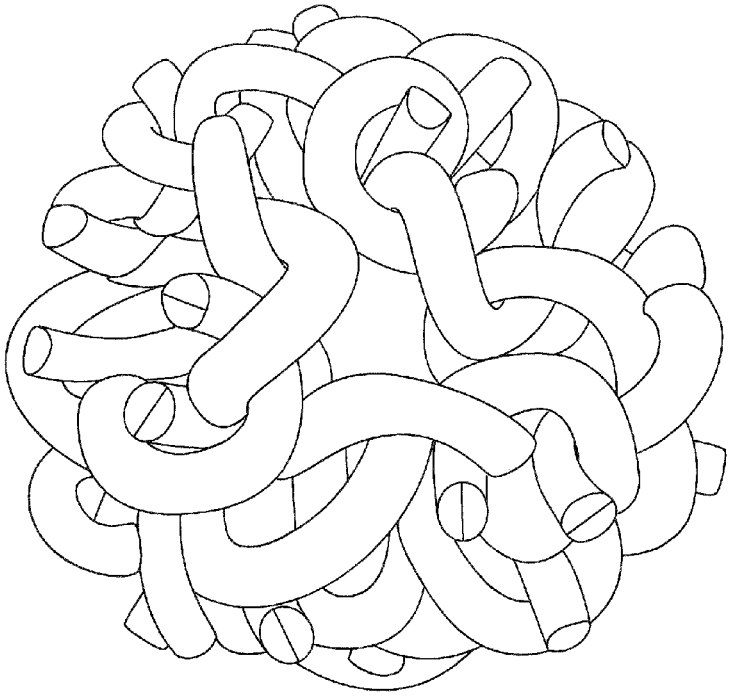

FIG. 8 demonstrates an icosahedral structure as seen along an axis that is aligned with the centers of opposing junctional rosettes.

It will be noted in subsequent figures that, as the length of stock helices is increased by adding additional turns, the equilateral triangles of an icosahedron are more closely approximated and become more obvious whilst the junctional rosettes remain identical, independent of the size of the icosahedral structure presented.

It will be noted that the forms thus far presented consist of the smallest possible icosahedral structure that it is possible to construct: one built with thirty helices; each of 2.5 turns in extension.

Figure 9:
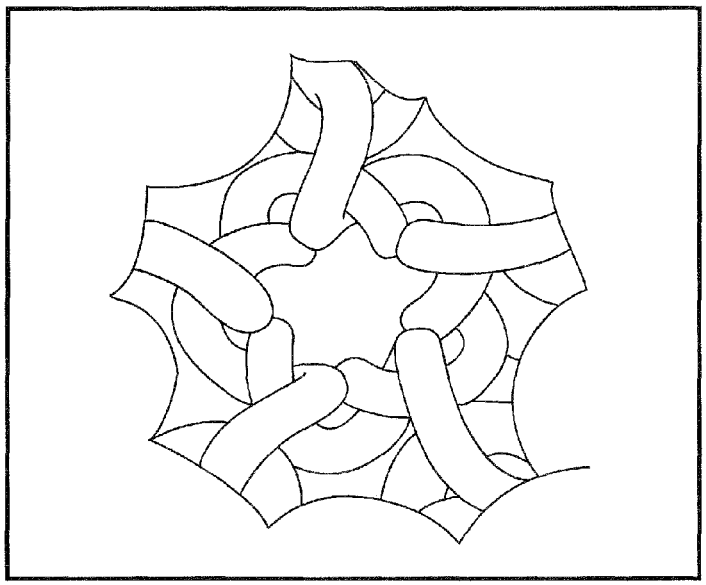

FIG. 9 shows the inside of a junctional rosette, viewed through the interstices of an icosahedral structure.

Figure 10:
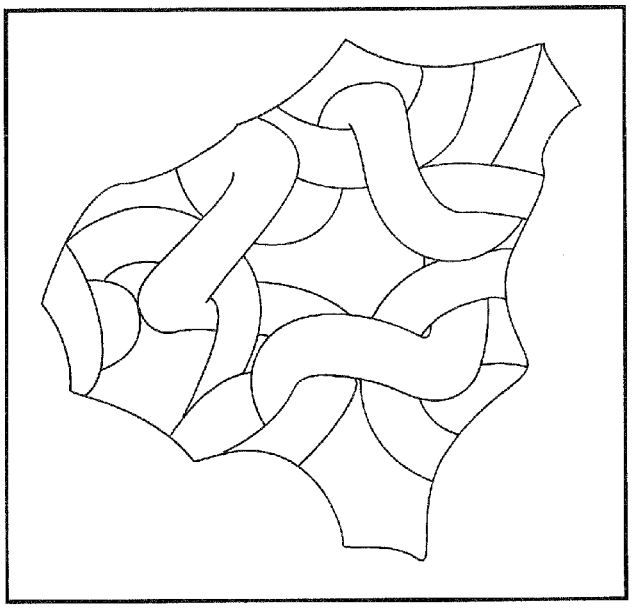

FIG. 10 shows an inner aspect of a triadic structure corresponding to a face, viewed via the interstices of an icosahedral structure.

Figure 11:
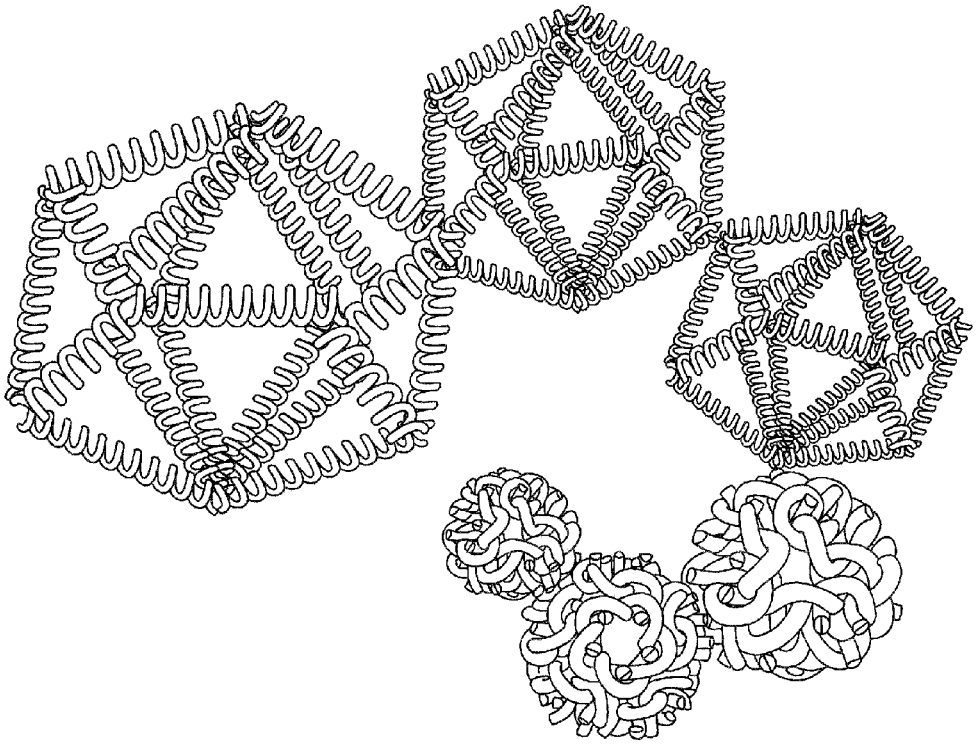

FIG. 11 shows a series of 6 conjoined icosahedral structures. Each constituent icosahedron, starting with the smallest such structure than can be constructed (one made from helices of 2.5 turns) is constructed with helices of ever-increasing length. Thus the icosahedra seen here consist of helices of 2.5, 3.5, 4.5, 5.5, 6.5 and 7.5 turns. It will be noted that the overall structure so constructed, resembles a logarithmic spiral, (like a Chambered Nautilus). If one had the patience and enough wire, the structure could be further elaborated, ad infiitum.

If one of the icosahedra is a third order (tertiary) structure, the assemblage, pictured here is a fourth order (quaternary) structure.

Regarding junctions between adjacent icosahedra: Not only do the junctional rosettes exhibit pentaradial symmetry, they also exhibit the property of mirror symmetry in the plane of the ring.

Therefore as demonstrated in this figure, it is possible for two adjacent structures to "share" a junctional ring and to thereby be mechanically conjoined. What this involves, from a practical standpoint, is the use of double-length helices in the shared junction such that the elongated helices (five in the current instance) participate in both icosahedra.

It will be further noted that the image in figure eight of a structure in which the icosahedra were conjoined using shared junctional rosettes chosen to produce the spiral structure seen.

An extremely large (in fact, infinite) number of alternative quaternary structures are possible at the election of the individual engaged in the construction. All such structures are nevertheless constrained to obey certain geometrically determined rules of assembly.

Figure 12:
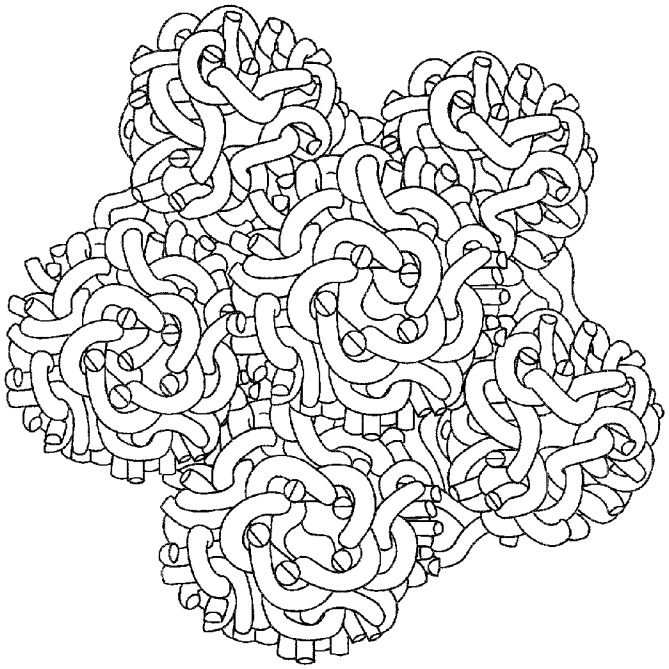

FIG. 12 further demonstrates the tremendous richness of construction possibilities inherent in this system—all of them geometrically constrained. More particularly, FIG. 12 shows a quaternary structure consisting of twelve of the smallest possible icosahedra, each sharing a junctional rosette with a central icosahedral structure of 3.5 turns. Each of the helices of the central structure are extended in length and each passes through two different planes of mirror symmetry shared (individually) with two of the icosahedra in the outer shell.

The assembly of such a structure is highly demanding to carry out, to be sure, but is made possible by the ability to advance or withdraw constituent helices by screwing them into or out of the object under construction.

All of the objects in FIG. 5-12 have, in common, the fact that they are all based on the helix specified in FIG. 1. An additional property of that helix is that of handedness. All helices are either left or right handed thus there are two "universes" based on handedness. Analogous structures in the two universes exhibit a variation on the theme of stereoisometry.

Figure 13:
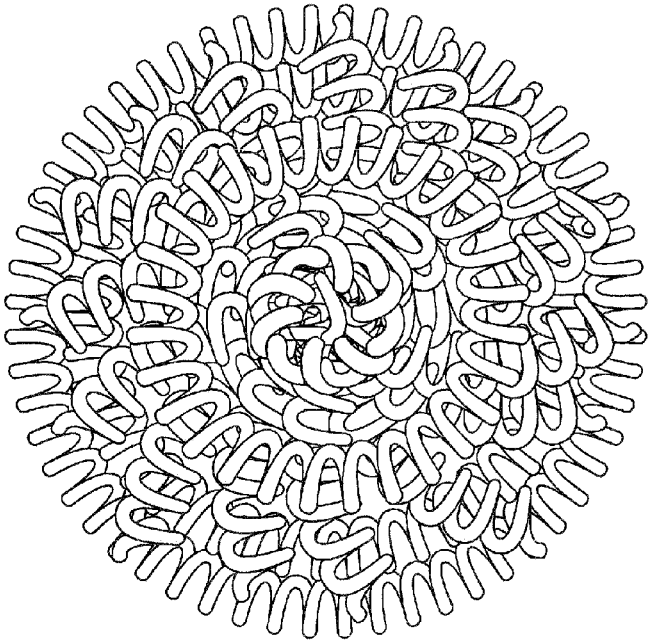

FIG. 13 illustrates how an infinity of structures that can be made using helical subunits defined by another unique set of parameters. If anything, the richness of structures made possible by this alternative helix is even greater than that of the previously described sub-unit.

The helix that is the repeating sub-unit for FIG. 13 and succeeding figures is defined as follows.

If the stock wire is defined as having a cross-sectional diameter of unity (1), then the core (mandrel) around which the helix is constructed as well as the spacer that determines the pitch of the sub-unit are also 1.0.

The structure shown here is an analog of a rhombic triacontahedron. In this structure, the essential feature of the constituent helix, described above, is its remarkable ability to participate in junctions that symmetrically incorporate either three or five such helices, once again with a highly specific angulation relative the plane of the junctional complex. This structure incorporates 60 helical sub-units arranged symmetrically around 12 pentagonal junctional rosettes. The opposite end of each subunit participates in a three-unit junction and between the helices are 20 rhombuses. The rhombic triacontahedron, one of the regular polytopes, exhibits icosahedral symmetry.

Figure 14:
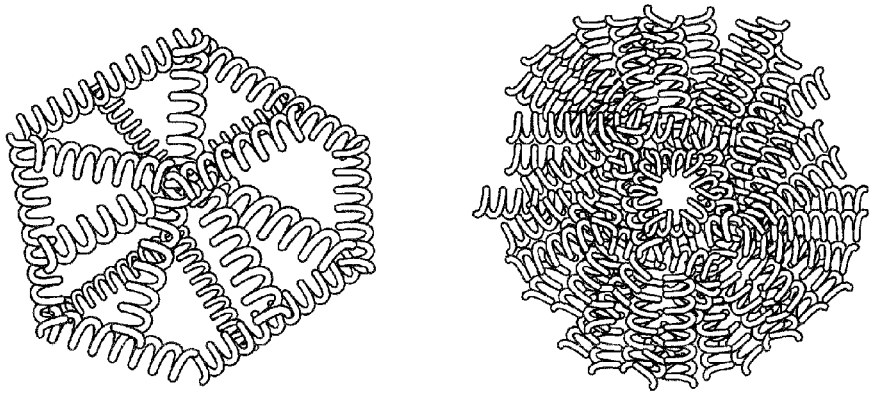
Figure 15:
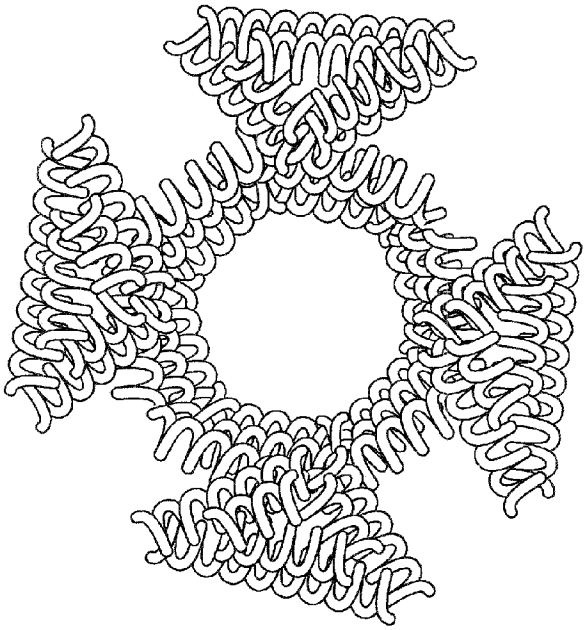
Figure 16:
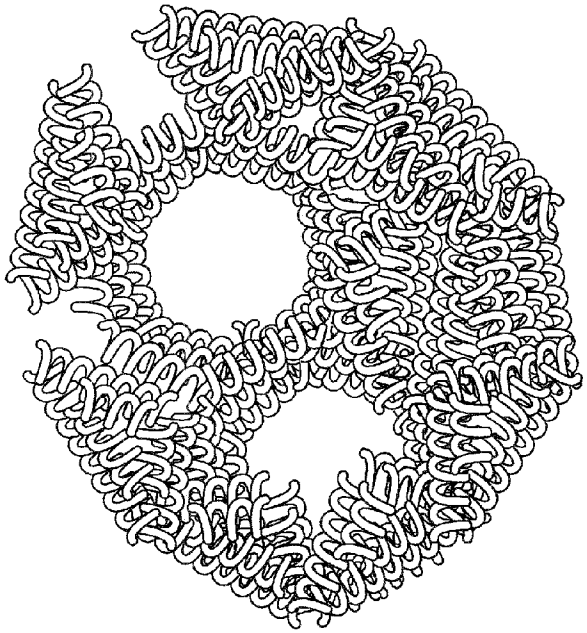

FIGS. 14-16 demonstrate several other structures that can constructed using the (1,1,1) helical sub-unit.

FIG. 14 shows a dodecahedron (12 faces. 20 apices, 30 edges). All of the apices incorporate three conjoined helices, symmetrically arranged. The other object in 12 is a tessellated dodecahedron.

FIG. 15 shows an "exploded" octahedron. Eight skewed equilateral triangular faces conjoined with diagonals that supply the third helix in each triadic junctional complex. (Using the tightest possible triad.)

FIG. 16 shows an exploded" icosahedron (Twenty skewed equilateral triangles conjoined with diagonals that supply the third helix in each triadic junctional complex, these complexes incorporating an extra helical turn and therefore having a less extreme angle with respect to the plane of the junctional complex.)

Figure 17:
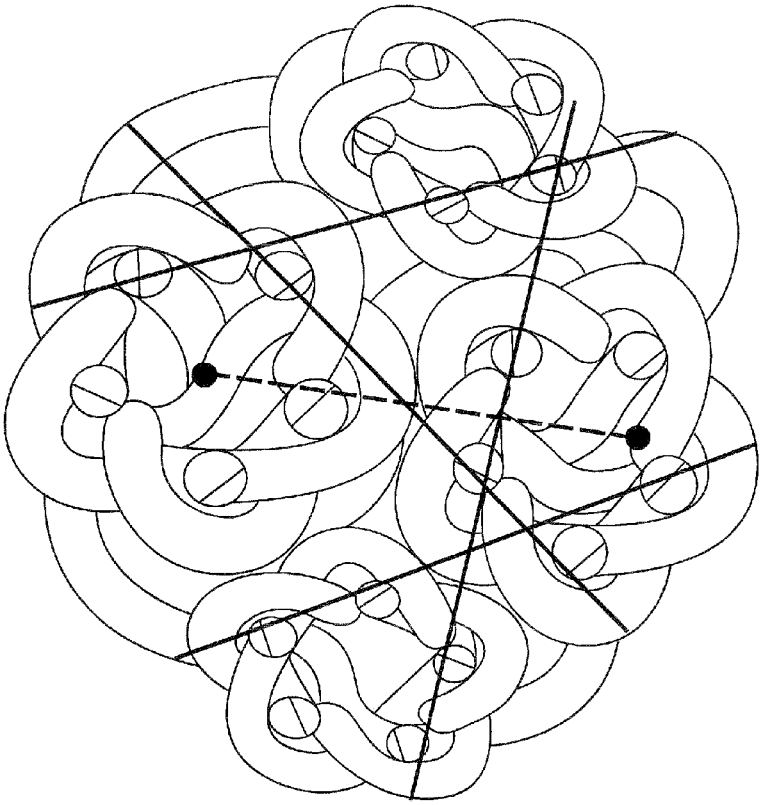

FIG. 17 highlights the difference between the skewed axis of a helix in an icosahedral construct VS the imaginary line connecting apices in an inscribed, traditional icosahedron.

Figure 18:
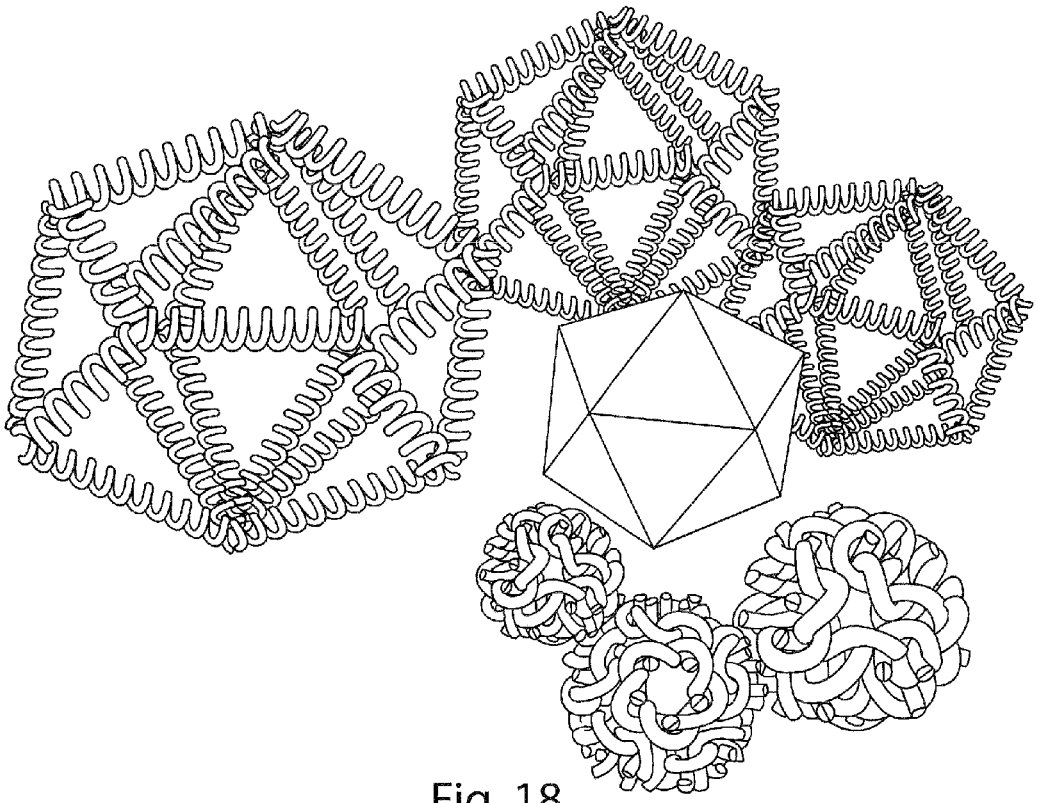

FIG. 18 shows a traditional Icosahedron constructed of paper and tape superimposed on an image of a construct encompassing an array of skewed icosahedra of differing sizes, as seen in an earlier figure.

The relative free volume of structures consistent with the present invention may be controlled by varying the number of turns in the helices of the construction units 10. The most condensed structures consistent with the present invention are formed using construction units 10 having two and one-half turns. According to such an embodiment, the twenty triangles constituting the icosahedral comprise small interstices between three adjacent rosettes. The rosettes, being tangential to one another, form a dodecahedral pattern. However, because the rosettes are not flat, the overall resultant structure appears spherical.

Alternate embodiments comprising construction units 10 having helices with more turns, e.g., three and one-half turns, four and one-half turns, five and one-half turns, etc., facilitate larger icosahedral structures in which the triangular faces are more defined, i.e., the triangles being larger relative to the typical rosettes, wherein the dimensions remain the same from one structure to the next independent of the length of the helices or the size of the triangular faces.

Consistent with the present invention, structures comprising linear arrays, branching structures, rings, large dodecahedra, etc. may be formed. The bisecting plane of the pentaradial symmetry of the rosettes makes it possible for each rosette to simultaneously participate in two, slightly overlapping icosahedra, and therein form a junction between the two. Each inter-icosahedra rosette comprises five extra-length construction units 10 engaged with one another to form a shared rosette, i.e., a rosette simultaneously participating in two icosahedra. Accordingly, each extra-length construction unit 10 terminates in an adjacent rosette in each of the joined icosahedra.

A feature of this system is that, whereas in all prior art, elements of extension are formally coincident with lines connecting the apices of geometrical figures, in the system presented here, all sub-units have an orientation that is off-axis and tangent to junctional rings that surround the formal axis on the underlying geometrical figure. Therefore, all forms generated by this system are highly regular, skewed variants of classical geometrical constructions; the "skewness" having the property of "handedness", determined by the handedness of the constituent helical subunit. Thus, depending on the handedness of the helix used in construction, all higher structures occupy a left or a right handed "universe". Left and right handed versions of a particular structure are therefore possible and exhibit a form of stereoisomerism, analogous to the phenomenon exhibited by various organic molecules. In a left or right handed universe, only the corresponding type of helix can be accommodated, however, the simultaneous use of right and left handed helices leads to the formation of a separate, class of structures, limited by the binary nature of left versus right-handedness but, nonetheless, interesting to explore.

Multiple modes of presentation are envisioned:

1. Construction system; toy mode: Helices, or the means by which an individual person may produce helices, is provided along with a user's guide explaining the underlying mathematics and assembly strategies along with images or diagrams of examples of structures that can be made. The user is thus enabled to explore the mathematically constrained but extremely rich set of structures that can be constructed using helical subunits. It is envisioned that if the helices are supplied in such a kit, they would come in long lengths, accompanied by a device for cutting the helices into desired lengths for different projects. Helices of various colored plastic would be striking in appearance.
2. Puzzle mode: A pre-assembled structure is presented as a puzzle and the user is challenged to disassemble and reassemble the puzzle. A package insert or a link to a web site provides assembly instructions in the event that the user is initially unable to do this on their own.
3. Puzzle mode alternative: A set of helical sub-units is presented unassembled and the user prompted that they can be assembled into a specific structure. It is then up to the user to figure out how assembly is carried out, with or without reference to a set of instructions provided with the puzzle or made available on a web site.
4. Desk top or shelf presentation piece consisting of a single example of one of the five Platonic Solids or a set of all five forms, offered for contemplation or study as aesthetic entities demonstrating the beauty of forms dictated by mathematical principles. Target Audience: students of mathematics, physics, chemistry, biology, engineering, art and architecture.

As regards presentation mode and utility, it is noted that the helical dimensional parameters can be scaled up or down depending on an intended use. Thus what might be a decorative item on a shelf at one scale might be a sculptural ornament in a garden at a larger scale, or even the support system for a tent or a dwelling at a larger scale. It is further noted that, in addition to manipulating the scale helical dimensions, the length of helical construction members, expressed as the number of turns, can also be varied. Thus, for example, the inventor of this system discovered that the smallest skewed icosahedron that can be made with the helix designed for this purpose consists of subunits (thirty of them in an icosahedron) each of which is 2.5 turns in length, however, successively larger icosahedra can be made by incorporating additional turns in the constituent sub units. The same holds true for the other Platonic solids and higher order forms.

In addition, it is noted that the rings via which helical subunits are conjoined have a plane of symmetry that allows the junctional rings to be shared by two adjacent structures in such a manner that higher order structures of virtually unlimited complexity can be constructed.

Thus, for illustrative purposes, as regards descriptors of successive levels of structural complexity; if the stock material from which helical subunits are manufactured is the primary structure, the helical sub-unit is a secondary structure, the skew form of any regular polytope is a tertiary structure and a complex structure incorporating multiple conjoined polytopes is a quaternary structure. It will be noted that all structures, secondary and above in such a hierarchy, exhibit left- or right-handedness based on the handedness of constituent sub-units.

In summary, the system according to the present invention may be employed in a variety of uses. According to a first use, the construction system may be employed as a puzzle or educational toy illustrating the above described principles. Additionally, the present invention may be utilized as an architectural element providing a high degree of configurational diversity while requiring only a small number of variant construction units. Still alternately, rigid, high surface area structures formed according to the present invention may be employed for catalytic and/or filtration processes and elements.

I claim:

1. A three dimensional structure consisting of:

a plurality of identical strands of the same constant cross-sectional shape, the same constant cross-sectional diameter, and the same handedness, each of said strands being a rigid, non-collapsible helix having at least two and one-half turns;

wherein the strands of said plurality of strands are interlocked so as to form a rigid, non collapsible, dimensionally and geometrically stable rosette and said helix has a constant cross-sectioned diameter.

2. The structure according to claim 1, wherein said helix has at least three and one-half turns.

3. The structure according to claim 1, wherein at least one said strand has a circular cross-section.

4. The structure according to claim 1, wherein said rosette has three, four or five or more apices.

5. The structure according to claim 1, wherein said structure formed is a Platonic Solid.

6. The structure according to claim 5, wherein said Platonic Solid is an icosahedron.

7. The structure according to claim 1, wherein said structure is a quaternary structure.

8. The structure according to claim 1, wherein said structure is a non-Platonic Solid.

9. The structure according to claim 1, wherein the interlocked elements are configured in a generally planar array.

10. The structure according to claim 1, wherein the interlocked elements are configured in a branched array.

11. The structure according to claim 1, wherein the interlocked elements are configured in a ringed array.

12. The structure according to claim 1, wherein the interlocked elements are configured in a dodecahedral array.

13. The structure according to claim 1, wherein the interlocked elements are configured in a spherical array.

14. The structure according to claim 1, wherein the interlocked elements are configured in an icosohedral array.

* * * * *